US006079810A

United States Patent [19]

Davis

[11] Patent Number: 6,079,810

[45] Date of Patent: Jun. 27, 2000

[54] METHODS AND APPARATUS FOR ADHESIVELY BONDING AN ORIFICE PLATE TO THE INTERNALLY CHAMBERED BODY PORTION OF AN INK JET PRINT HEAD ASSEMBLY

[75] Inventor: Jimmy H. Davis, Cypress, Tex.

[73] Assignee: Compaq Computer Corporation, Houston, Tex.

[21] Appl. No.: 08/298,375

[22] Filed: Aug. 30, 1994

Related U.S. Application Data

[63] Continuation of application No. 08/007,746, Jan. 22, 1993.

[51] Int. Cl.[7] ..... B41J 2/135

[52] U.S. Cl. ..... 347/47

[58] Field of Search ..... 347/20, 47; 156/252, 156/290, 291, 292, 295

[56] References Cited

U.S. PATENT DOCUMENTS

| | | | |
|---|---|---|---|
| 3,962,015 | 6/1976 | Heimann | 156/295 |
| 4,115,178 | 9/1978 | Cone et al. | 156/295 |
| 4,274,901 | 6/1981 | Elber | 156/252 |
| 4,528,578 | 7/1985 | Matsuda et al. . | |
| 4,668,548 | 5/1987 | Lankard | 156/252 |
| 4,954,383 | 9/1990 | King et al. | 156/252 |
| 5,189,437 | 2/1993 | Michaelis et al. . | |

FOREIGN PATENT DOCUMENTS

| | | | |
|---|---|---|---|
| 1078585 | 3/1960 | Germany | 156/252 |
| 118871 | 9/1981 | Japan | 347/20 |
| 0144360 | 7/1986 | Japan . | |
| 124956 | 6/1987 | Japan | 347/47 |
| 169623 | 7/1987 | Japan | 156/252 |
| 228861 | 9/1989 | Japan | 347/20 |

*Primary Examiner*—N. Le
*Attorney, Agent, or Firm*—Konneker & Smith, P.C.

[57] ABSTRACT

An orifice plate is operatively secured to the open front end of an internally chambered piezoelectric ceramic body portion of an ink jet print head assembly material using an adhesive material. In securing these two components to one another, a layer of the adhesive material is applied to the front end of the print head body and the orifice plate is pressed against the adhesive layer. The ultimate bond strength of the adhesive material is substantially increased by the presence of a spaced plurality of bonding holes formed through the orifice plate and aligned with a spaced plurality of bonding openings extending inwardly through the front end of the print head body. As the orifice plate is pressed against the body, substantial portions of the initially applied adhesive material layer are forced into the aligned holes and openings. When the overall adhesive body hardens, the bond interfaces between these adhesive portions and the interior side surfaces of the holes and openings receiving them resist outward separation of the orifice plate from the print head body in shear, thereby substantially increasing the overall securement strength of the hardened adhesive material.

19 Claims, 1 Drawing Sheet

METHODS AND APPARATUS FOR ADHESIVELY BONDING AN ORIFICE PLATE TO THE INTERNALLY CHAMBERED BODY PORTION OF AN INK JET PRINT HEAD ASSEMBLY

This is a continuation of application Ser. No. 08/007,746, filed Jan. 22, 1993.

BACKGROUND OF THE INVENTION

1. Field of the Invention

The present invention generally relates to print head apparatus used in ink jet printers, and more particularly relates to methods and apparatus used to adhesively bond an orifice plate to the channeled body portion of an ink jet print head assembly.

2. Description of Related Art

A conventionally fabricated print head assembly for an ink jet printer typically includes a piezoelectric ceramic body portion through which a spaced apart series of parallel ink chambers extend from the front end of the body to its rear end. The open chamber ends at the rear end of the body are suitably communicated with the interior of an ink reservoir to receive ink therefrom, and an orifice plate, typically formed from a polymer material, is secured over the open front end of the body using a generally planar layer of high strength adhesive material. A spaced series of ink discharge orifice openings are formed through the orifice plate, and are aligned with and positioned over the open front ends of the body chambers.

During operation of the print head, an electrical actuation pulse is transmitted to a metallized contact area associated with a selected one of the body chambers to piezoelectrically cause the lateral constriction of its walls for the duration of the pulse. This wall constriction momentarily elevates the ink pressure within the chamber, thereby forcing a small quantity of ink, in droplet form, outwardly through its associated orifice opening for use in the overall ink jet printing process.

The rise in chamber ink pressure used to form and discharge the ink droplet correspondingly exerts a forwardly directed pressure force on the adhesively bonded orifice plate. This piezoelectrically generated pressure force has proven in many instances to be of a magnitude sufficient to cause premature failure of the print head assembly due to separation of the orifice plate from the print head body caused by tensile failure at the bond interface between the hardened adhesive material layer and the orifice plate and/or the print head body.

To a large extent this separation problem can be alleviated simply by using an adhesive material having a considerably greater bonding strength. However, adhesive material having sufficient bonding strength in this particular pressure/material application is typically very expensive and undesirably increases the overall fabrication cost of the print head assembly by a significant amount. Using conventional orifice plate/body bonding techniques, the print head designer is thus faced with a choice between two undesirable alternatives—the possibility of premature assembly failure or the reality of significantly increased assembly fabrication costs.

It can be readily seen from the foregoing that a need exists for improved methods and apparatus for adhesively bonding an orifice plate to the chambered body portion of an ink jet print head assembly. It is accordingly an object of the present invention to provide such improved methods and apparatus.

SUMMARY OF THE INVENTION

In carrying out principles of the present invention, in accordance with a preferred embodiment thereof, an improved method is provided for adhesively bonding an orifice plate to the front end surface of an internally chambered piezoelectric body portion of a print head assembly for an ink jet printer.

A spaced series of bonding openings is formed in at least one of the orifice plate and the front end surface of the body portion. Preferably, such bonding openings are formed in each of the orifice plate and print head body portion, with the orifice plate openings being alignable with the body portion openings and being defined by holes extending transversely through the orifice plate.

To securely bond the orifice plate to the print head body portion, the rear side surface of the orifice plate is positioned in an opposing, closely adjacent relationship with the front end surface of the body portion, with a layer of an adhesive material sandwiched between the opposing orifice plate and body portion surfaces. The orifice plate and print head body portion are then forced toward one another in a manner decreasing the thickness of the adhesive material layer while causing portions thereof to flow into the bonding openings.

After the adhesive material hardens, the thinned original layer of adhesive intersecures the facing orifice plate and body portion surfaces, and the portions of the adhesive flowed into the bonding openings is bonded to their interior side surfaces. During operation of the completed print head assembly, the forwardly directed fluid pressure periodically exerted on the orifice plate is strongly resisted in shear at the peripheral adhesive/component interfaces within the bonding openings.

The print head assembly fabricated by this method is thus advantageously provided with a considerably greater orifice plate/body portion adhesive securement strength than print head assemblies using conventional adhesive bonding techniques at this component interface area.

DETAILED DESCRIPTION

Figure 1:
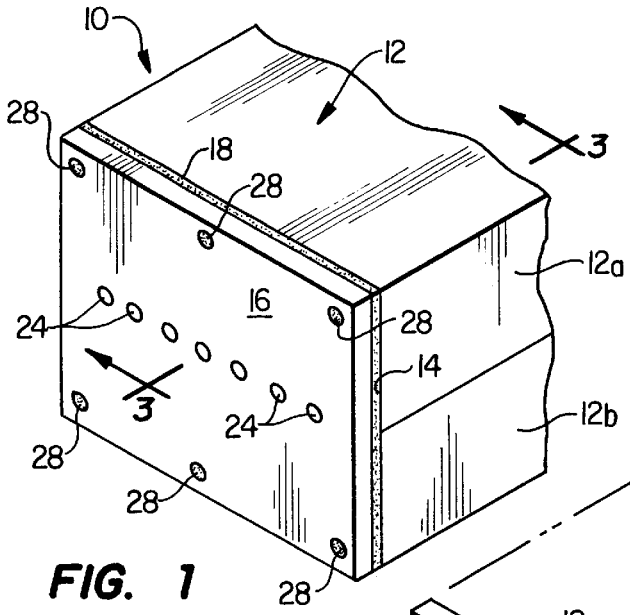
FIG. 1 is a schematic perspective view of a front end portion of an ink jet print head assembly having a channeled piezoelectric ceramic body portion to which an orifice plate is operatively secured using an improved adhesive bonding method embodying principles of the present invention.
Figure 2:
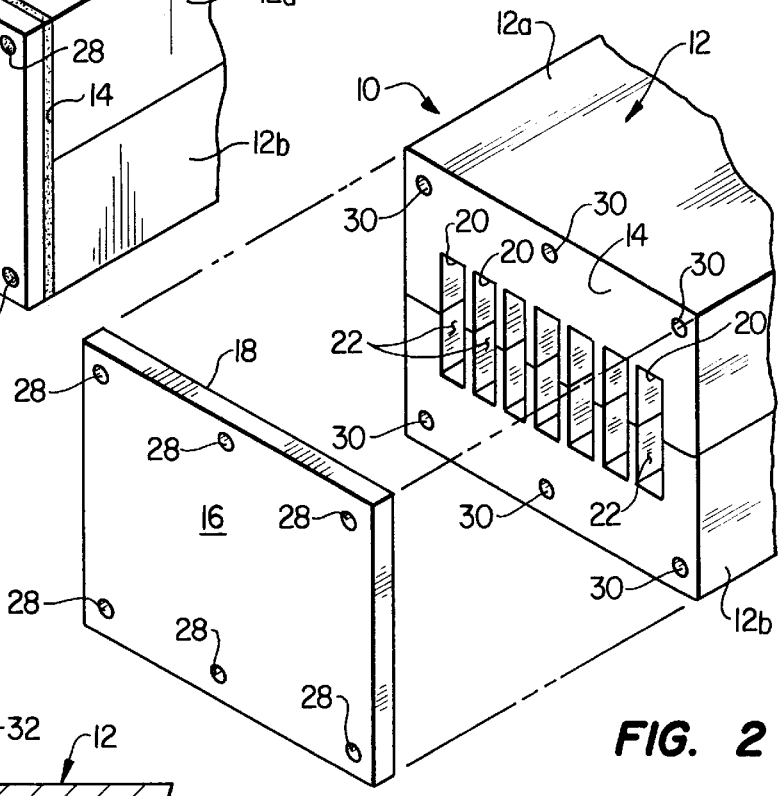
FIG. 2 is an exploded perspective view of the print head portion prior to adhesive securement of the orifice plate to the channeled body portion.

Perspectively illustrated in schematic form in FIGS. 1 and 2 is a front end portion of a print head assembly 10 for use in an ink jet printer. Assembly 10 includes a generally rectangular piezoelectric ceramic body 12 having a front end surface 14, and a rectangular orifice plate 16 formed from a polymer material and having a rear side surface 18 with a peripheral configuration substantially identical to that of the front end surface 14 of the ceramic body 12.

With the important exception noted below, the piezoelectric ceramic body 12 is conventionally formed from rectangular top and bottom halves 12*a*,12*b* into side surfaces of which spaced series of parallel, rectangularly cross-sectioned channels 20 are cut. The channel walls are passivated or coated in a conventional manner to prevent electrical "cross-talk" between adjacent channels, and metallized areas (not shown) are provided on the channels to provide electrical contact areas thereon to receive electrical actuating pulses for purposes later described.

The body halves 12*a*,12*b* are then suitably secured to one another in a manner such that the open sides of their channels 20 face and are precisely aligned with one another to define within the body 12 a spaced series of parallel interior chambers 22 which open outwardly through the front end surface 14 of the body 12 and its rear end surface (not shown), and the piezoelectric body 12 is appropriately polarized. In the completed print head 10, each of the chambers 22 is filled with ink 24 (see FIG. 3) delivered from an ink reservoir portion (not shown) of the print head.

After the orifice plate 16 has been fixedly secured to the front end surface 14 of the body 12 in a manner subsequently described (see FIGS. 1 and 3), a horizontally spaced series of circular ink discharge orifice openings 24 are transversely formed through a vertically central portion of the orifice plate 16. The orifice openings 24 are horizontally aligned with the open front ends of the body channels 22 in a manner such that each channel 22 is communicated with a different one of the orifice openings. A conventional laser ablation process is preferably used to form the orifice openings 24, and the orifice plate 16 is shown in FIG. 2 prior to this orifice forming step.

Figure 3:
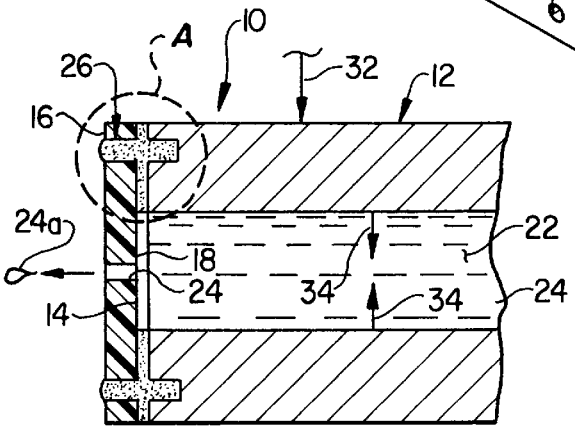
FIG. 3 is a cross-sectional view through the print head portion taken along line 3—3 of FIG. 1.
Figure 4:
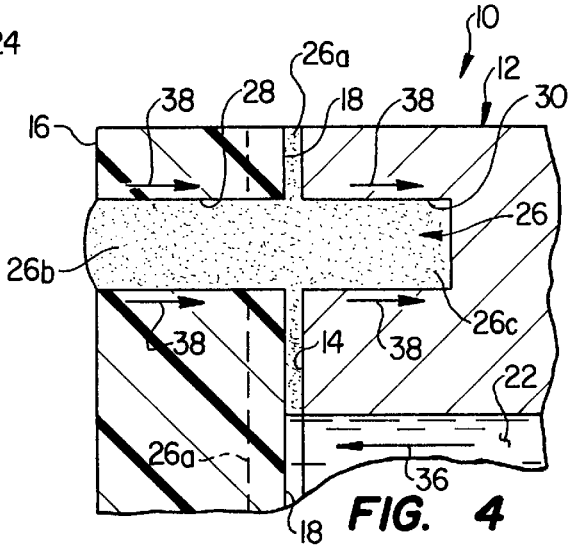
FIG. 4 is an enlargement of the circled area "A" in FIG. 3.

The orifice plate 16 is bonded to the front end surface 14 of the print head body 12 using a suitable high strength adhesive material indicated generally at 26 in FIGS. 3 and 4. Referring now to FIGS. 1–4, according to a key aspect of the present invention the operative bond strength of the adhesive 26 is substantially increased, as subsequently described, by virtue of the unique presence of a spaced pluralities of circular holes 28 formed transversely through the orifice plate 16, representatively adjacent its top and bottom side edges, and corresponding pluralities of circular openings 30 extending rearwardly into the body 12 through its front end surface 14.

The array of orifice plate holes 28 and the array of body openings 30 are relatively positioned in a manner such that they are aligned with one another when the orifice plate 16 is operatively secured to the front end of the body 12. A conventional laser ablation process may be used to rapidly form the holes 28 and the openings 30.

With reference now to FIG. 4, to operatively bond the orifice plate 16 to the front end surface 14 of the print head body 12, a relatively thick layer 26*a* (having the indicated dotted line thickness) of the adhesive material 26 is applied to the front end surface 14 of the body 12. The aligned orifice plate 16 and body 12 are then pressed together. This causes the thickness of the initially applied adhesive layer 26*a* to be reduced to its indicated solid line thickness, while at the same time forcing portions 26*b*,26*c* of the now thinner adhesive portion 26*a* respectively into the aligned orifice plate hole and body opening pairs 28,30 to essentially fill them with adhesive.

Additionally, some of the adhesive is forced outwardly from the periphery of the joined orifice plate 16 and body 12. This portion of the adhesive can simply be wiped away before it hardens. When the remaining body of the adhesive 26 hardens within the interior of the print head 10, it can be seen in FIG. 4 that the relatively thin layer 26*a* is bonded to the facing surfaces 14,18 of the body 12 and the orifice plate 16, the adhesive portions 26*b* are bonded to the interior peripheries of the orifice plate holes 28, and the adhesive portions 26*c* are bonded to the interior side surfaces of the body openings 30 as well as being bonded to their inner end surfaces.

Referring now to FIGS. 3 and 4, during operation of the print head 10, an electrical actuation pulse 32 (FIG. 3) is transmitted from a power source (not shown) to the electrical contact area of a selected one of the ink-filled body chambers 22, thereby piezoelectrically causing the side walls of the selected chamber to laterally constrict, as schematically indicated by the arrows 34 in FIG. 3, for the duration of the pulse. This temporary lateral chamber constriction drives a small portion of the ink 24 in the chamber outwardly through its associated plate orifice 24, in the form of an ink droplet 24*a*, for use in the ink jet printing process. The momentary lateral constriction of the selected chamber 22, of course, creates a corresponding increase in the fluid pressure therein, thereby imposing a forwardly directed pressure force 36 (see FIG. 4) on the rear side surface 18 of the orifice plate 16.

In conventionally fabricated print head assemblies, the orifice plate 16 is bonded to the front end of the body 12 only by a thin layer of adhesive material corresponding to the layer 26*a* shown in FIG. 4. Accordingly, in response to the generation of the forwardly directed pressure force 36 all of the adhesive/component bond interface areas are subjected essentially entirely to tensile separation stresses perpendicular to the plane of the thin adhesive layer interposed between the orifice plate and print head body.

In conventionally constructed print head assemblies, the tensile strength of the adhesive/component bond interface area has often proven to be insufficient to prevent eventual separation of the orifice plate from the print head body portion. Heretofore, this potential separation problem has necessitated the use of ultra high strength adhesive material. Due to the very high cost of such adhesive material, however, this solution is simply not a satisfactory one.

A considerably more economical solution to this potential separation is provided by the present invention via its unique incorporation in the print head assembly 10 of the orifice plate holes 28 and the body openings 30 which, as will now be described, greatly strengthens the bonding strength of the adhesive material 26. Because of this greatly increased bonding strength, a lower cost adhesive may be used and the possibility of fluid pressure separation of the orifice plate 16 from the print head body 12 is substantially eliminated.

Still referring to FIG. 4, it can be seen that in response to the creation of the forwardly directed fluid pressure force 36, resistive shear forces 38 are created at the bond junctures between the adhesive portions 26*b* and the interior side surfaces of the orifice plate holes 28, and at the bond junctures between the adhesive portions 26*c* and the interior side wall peripheries of the body openings 30, in addition to the resistive tensile forces created at the bond interface areas on the facing surfaces 14,18 of the body 12 and the orifice plate 16.

The shear strength of the side wall bond interface areas within the orifice plate holes 28 and the body openings 30 is substantially stronger than the tensile bond strength along the bond interface areas on the facing surfaces 14,18. Accordingly, the overall bonding strength of the adhesive material 26 is greatly increased, and the potential for operational pressure separation of the orifice plate 16 from the print head body 12 is substantially reduced without the use of a very costly adhesive material.

Analyzing the mechanics of the overall body of hardened adhesive material 26 (i.e., the adhesive portions 26*a*,26*b* and 26*c*) it can be seen that the resistive shear stress provided by the adhesive portions 26*b*,26*b* substantially reduces the tensile stresses created at the interfaces between the adhesive portion 26*a* and the facing orifice plate and print head body surfaces 18 and 14. It can also be seen that the total adhesive/component bond interface area is substantially increased by the provision of the holes 28 and openings 30, and that the holes 28 and openings 30 function to receive adhesive material 26 as the orifice plate 16 and body 12 are initially pressed together, thereby reducing the amount of adhesive material squeezed outwardly through the periphery of the joined orifice plate and print head body and ultimately wasted.

It can readily be seen that the orifice plate bonding technique provided by the present invention is quite simple to carry out, yet can appreciably reduce the fabrication cost associated with the overall print head assembly while at the same time greatly strengthening the assembly at its important orifice plate/body juncture. While it is preferable to utilize both the orifice plate holes 28 and the body openings 30, a lesser though still desirable degree of bonding strength increase could be achieved by using either the holes 28 or openings 30. Additionally, while it is preferable that the holes 28 be aligned with the openings 30 as illustrated, a substantial degree of bond strengthening would still be achieved if the holes 28 and openings 30 were offset from one another. Furthermore, the illustrated holes 28 could be replaced with openings extending through the rear side surface of the orifice plate and terminating inwardly of its front side surface.

The foregoing detailed description is to be clearly understood as being given by way of illustration and example only, the spirit and scope of the present invention being limited solely by the appended claims.

What is claimed is:

1. A method of fabricating a print head assembly for use in an ink jet printer, said method comprising the steps of:

providing a print head body portion formed from a piezoelectric material and having a front end surface, and a spaced interior series of parallel ink receiving chambers opening outwardly through said front end surface;

providing an orifice plate having a rear side surface;

forming spaced apart adhesive receiving openings in said orifice plate and said front end surface of said body portion;

applying a layer of adhesive material between said front end surface of said body portion and said rear side surface of said orifice plate;

forcing said orifice plate and said body portion toward one another in a manner reducing the thickness of said layer of adhesive material and causing portions of said layer of adhesive material to flow into said adhesive openings in both said orifice plate and said body portion, to thereby strengthen the adhesive bond between said orifice plate and body portion by increasing the total contact area between said adhesive material and said orifice plate and body portion; and permitting the adhesive material to harden.

2. A print head assembly fabricated by the method of claim 1.

3. The method of claim 1 wherein said providing steps are performed using a print head body portion formed from a piezoelectric ceramic material, and an orifice plate formed from a polymer material.

4. A print head assembly fabricated by the method of claim 3.

5. The method of claim 1 wherein said forming step is performed by forming spaced apart bonding openings in each of said orifice plate and said front end surface of said body portion.

6. A print head assembly fabricated by the method of claim 5.

7. The method of claim 5 further comprising the step of aligning said bonding openings in said orifice plate with said bonding openings in said front end surface of said body portion prior to performing said forcing step.

8. A print head assembly fabricated by the method of claim 7.

9. The method of claim 1 wherein said forming step includes the step of forming a spaced series of bonding holes transversely through said orifice plate.

10. A print head assembly fabricated by the method of claim 9.

11. A method of fabricating a print head assembly for use in an ink jet printer, said method comprising the steps of:

providing a print head body portion formed from a piezoelectric ceramic material and having a front end surface and a spaced interior series of parallel ink receiving chambers opening outwardly through said front end surface;

providing an orifice plate formed from a polymer material and having opposite front and rear side surfaces;

forming a spaced apart series of adhesive bonding holes transversely through said orifice plate;

forming a spaced apart series of adhesive bonding openings in said body portion, said adhesive bonding openings extending inwardly through said front end surface of said body portion and being alignable with said adhesive bonding holes in said orifice plate;

applying a layer of adhesive material having a thickness between said front end surface of said body portion and said rear side surface of said orifice plate;

aligning said adhesive bonding holes with said adhesive bonding openings;

forcing said orifice plate and said body portion toward one another in a manner reducing said thickness of said layer of adhesive material and causing portions thereof to flow into said adhesive bonding holes and said adhesive bonding openings, to thereby increase the contact surface area of said adhesive material with said orifice plate and said body portion and form a stronger adhesive bond therebetween; and permitting the adhesive material to harden.

12. A print head assembly fabricated by the method of claim 11.

13. A print head assembly for use in an ink jet printer, comprising:

a body portion formed from a piezoelectric material and having a front end surface and a spaced apart interior series of ink receiving chambers opening outwardly through said front end surface;

an orifice plate having a front side surface and having a rear side surface disposed in an opposing, closely adjacent relationship with said front end surface of said body portion, said orifice plate and said front end surface of said body portion having a spaced series of adhesive bonding openings formed therein and having interior side surface portions, said adhesive bonding openings of said orifice plate being alignable with respective ones of said adhesive bonding openings in said front end surface of said body portion; and an adhesive material having a first portion positioned between and adhesively intersecuring said rear side surface of said orifice plate and said front end surface of said body portion, and a spaced series of second portions connected to said first portion, said second portions extending into respective ones of said adhesive bonding openings in both said orifice plate and said front end surface of said body portion, and being adhered to said interior side surface portions thereof.

14. The print head assembly of claim 13 wherein:

said body portion is formed from a piezoelectric ceramic material, and said orifice plate is formed from a polymer material.

15. The print head assembly of claim 13 wherein:

each of said orifice plate and said front end surface of said body portion has a spaced series of bonding openings formed therein.

16. The print head assembly of claim 15 wherein:

said bonding openings in said orifice plate are aligned with said bonding openings in said front end surface of said body portion.

17. The print head assembly of claim 16 wherein:

said bonding openings in said orifice plate are defined by a spaced series of holes extending transversely through said orifice plate between its front and rear side surfaces.

18. A method of fabricating a print head assembly for use in an ink jet printer, said method comprising the steps of:

providing a print head body portion formed from a piezoelectric material and having a front end surface, and a spaced interior series of parallel ink receiving chambers opening outwardly through said front end surface;

providing an orifice plate having a rear side surface;

respectively forming first and second spaced apart pluralities of adhesive receiving openings in said orifice plate and said front end surface of said body portion;

sandwiching a layer of adhesive material between said front end surface of said body portion and said rear side surface of said orifice plate, the sandwiched layer of adhesive material having a first side contacting said front end surface of said body portion and a second side contacting said rear side surface of said orifice plate;

forcing said orifice plate and said body portion toward one another in a manner reducing the thickness of the sandwiched layer of adhesive material and simultaneously causing portions of the sandwiched layer of adhesive material to flow, in opposite directions from said first and second sides of the sandwiched layer of adhesive material, into said first and second spaced apart pluralities of adhesive receiving openings in said orifice plate and said front end surface of said body portion to thereby strengthen the adhesive bond between said orifice plate and body portion by increasing the total contact area between the sandwiched layer of adhesive material and said orifice plate and body portion; and permitting the sandwiched layer of adhesive material to harden.

19. A print head assembly fabricated by the method of claim 18.

* * * * *